United States Patent [19]

Laskin

[11] Patent Number: 4,572,051

[45] Date of Patent: Feb. 25, 1986

[54] HUMIDIFICATION DEVICE FOR MUSICAL INSTRUMENTS

[76] Inventor: William Laskin, 192 Dupont St., Toronto, Ontario M5R 2E6, Canada

[21] Appl. No.: 636,777

[22] Filed: Aug. 1, 1984

[51] Int. Cl.[4] ..... G10G 7/00

[52] U.S. Cl. ..... 84/453; 239/57

[58] Field of Search ..... 84/453; 239/53–60

[56] References Cited

U.S. PATENT DOCUMENTS 3,407,700 10/1968 Hollander ..... 84/453
3,412,935 11/1968 O'Keeffe ..... 239/58 X
3,721,152 3/1973 Von Meyer ..... 84/453
4,161,283 7/1979 Hyman ..... 239/55

*Primary Examiner*—Lawrence R. Franklin
*Attorney, Agent, or Firm*—Robert F. Delbridge; Arne I. Fors

[57] ABSTRACT

A humidification device for a stringed musical instrument includes a bag of porous synthetic plastic material which permits water vapor and not water droplets to pass therethrough, the bag having releasable sealing means for opening and closing the bag, a water-absorbing material in the bag, and attachment means carrying the bag and attachable to at least a pair of strings of the instrument to position the bag adjacent or in the instrument body.

11 Claims, 8 Drawing Figures

Figure 3:
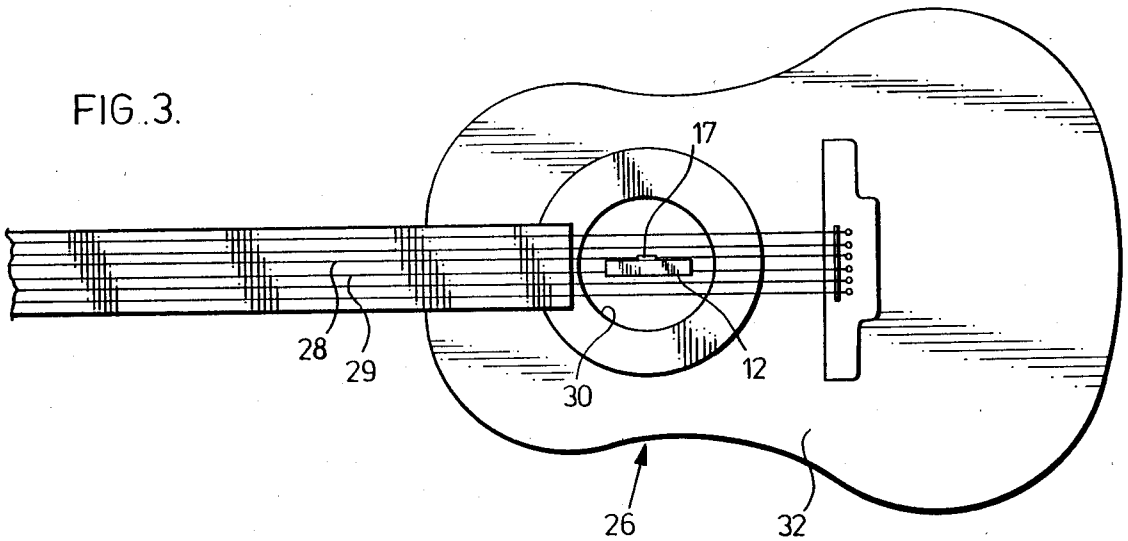

FIG. 1.
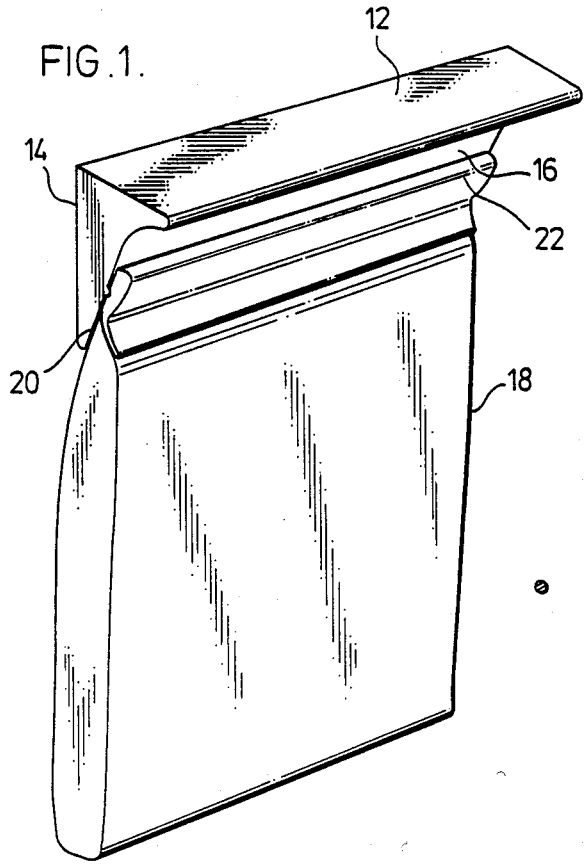
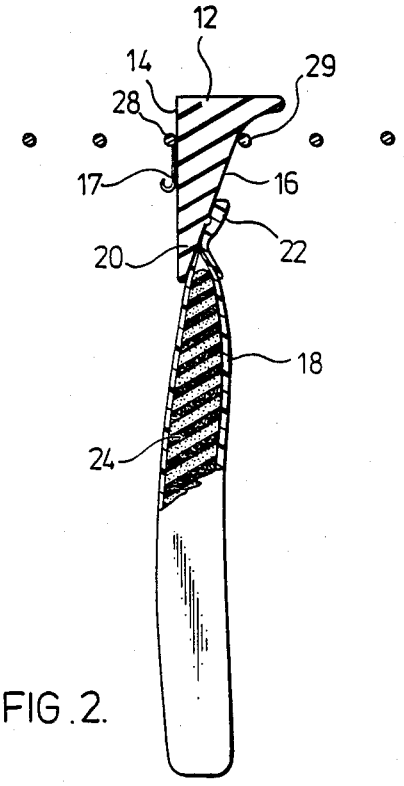
FIG. 2.

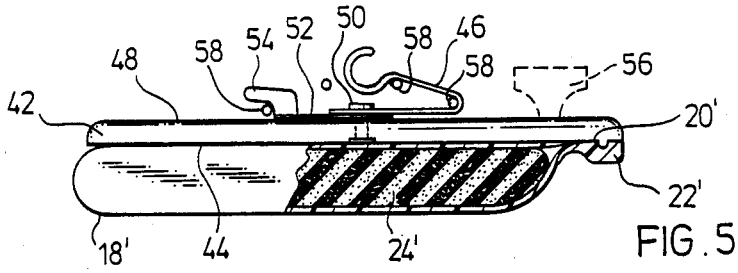
FIG. 5.
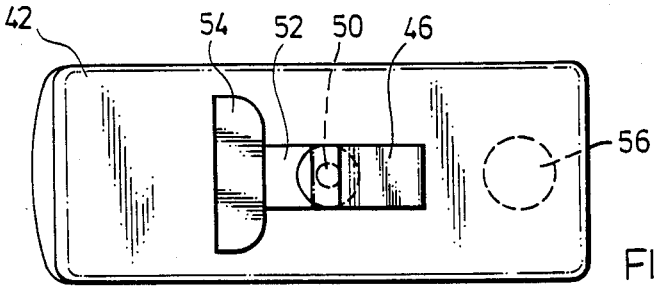
FIG. 6.
FIG. 7.
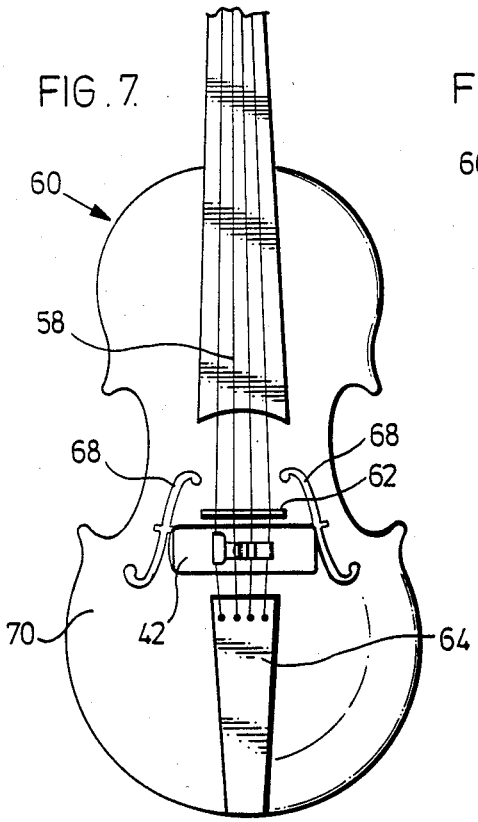
FIG. 8.
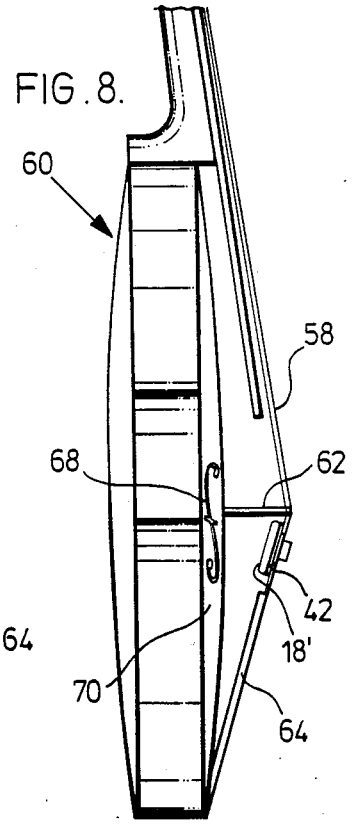

HUMIDIFICATION DEVICE FOR MUSICAL INSTRUMENTS

This invention relates to humidification devices for musical instruments, especially stringed instruments with wooden bodies such as guitars and the violin family.

It is well known that musical instruments are adversely affected by low humidity, i.e. an undesirably dry atmosphere. With stringed instruments having wooden bodies, low humidity not only causes general loss of tonality but may also cause structural damage such as cracking, seam separation and warping. It is therefore essential to humidify such instruments in their cases in low humidity conditions, for example such as occur during a cold winter season.

Humidification devices for such purposes are available, but known humidification devices are not particularly satisfactory because they do not release moisture at an optimum rate and/or they quickly exhaust their store of moisture. Also, humidification devices which are placed in a case alongside an instrument, do not sufficiently humidify the most humidity sensitive area of the instrument, namely its main body. Other humidification devices which extend into the body are unsatisfactory because known devices of this kind allow water droplets to escape, with consequent likelihood of water damage to the interior of the body. Such humidification devices may also be required to be secured to the body and consequently cause damage at the point of attachment.

It is therefore an object of the invention to provide an improved humidification device which is specially suitable for stringed musical instruments with wooden bodies.

According to the invention, a humidification device has a bag comprising porous synthetic plastic material which permits water vapour and not water droplets to pass therethrough said bag having releasable sealing means for opening and closing the bag, a water-absorbing material in the bag, and attachment means carrying the bag and attachable to at least a pair of strings of an instrument to position the bag adjacent or in the instrument body.

A humidification device in accordance with the invention releases water as vapour, not as droplets, and its relatively large vapour-releasing area effects effective humidification, of an instrument in its case for a satisfactorily long period of time. Also, no damage is caused to the instrument body by water absorption or by the attachment of the humidification device to the strings of the instrument.

The bag may be of expanded polytetrafluoroethylene, which preferably has a pore size of less than 0.5 microns, and more preferably a pore size of about 0.02 microns.

The water absorbing material may comprise sponge material, for example reticulated foam which preferably has from about 50 to about 100 pores per inch, more preferably from about 80 to about 90 pores per inch.

The attachment means may comprise a generally wedge-shaped member with the bag suspended from a narrow end thereof to enable the attachment means to be wedged between a pair of strings of a guitar, the guitar having a hollow main body with a sound hole therein, with the bag extending through the sound hole into the hollow guitar body. The wedge-shaped member may carry a clip member engageable with one of the strings to retain the wedge-shaped member is position.

Alternatively, for a member of the violin family, the attachment means may comprise a plate-like member carrying hook-shaped members to enable the plate-like member to be mounted under the strings with the hook-shaped members engaging a pair of strings, the bag being carried by the plate-like member so as to be positioned between the plate-like member and the body of the instrument.

Figure 4:
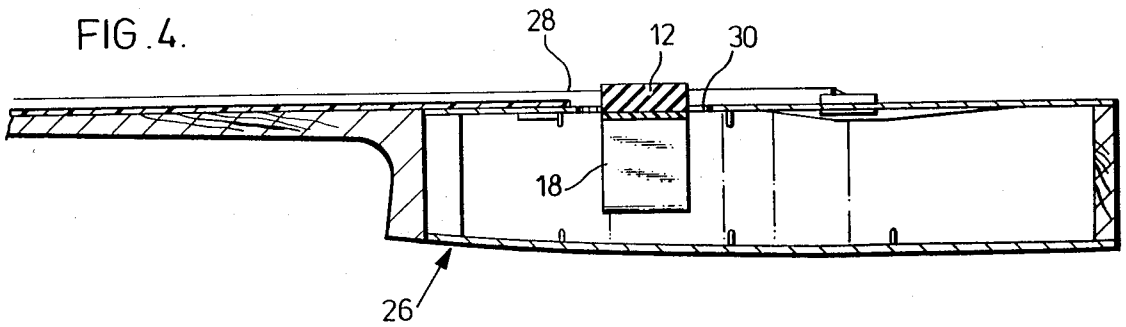

Embodiments of the invention will now be described, by way of example, with reference to the accompanying drawings, of which:

FIG. 1 is a perspective view of a humidification device intended for use with the guitar, FIG. 2 is a side view, partly in section, of the humidification device of FIG. 1, with guitar strings also being shown to indicate the manner in which the humidification device is attached thereto, FIG. 3 is a front view of a guitar with the humidification device attached thereto, FIG. 4 is a side view, partly in section, of the guitar and humidification device, FIG. 5 is a side view, partly in section, of a humidification device intended for use with a violin or other member of the violin family, FIG. 6 is a plan view of the humidification device of FIG. 5, FIG. 7 is a front view of a violin and the humidification device attached thereto, and FIG. 8 is a side view of the violin and humidification device.

Referring first to FIGS. 1 to 4, a humidification device for use with a guitar comprises an elongated rubber attachment member 12 of generally wedge-shaped section, with a vertical side wall 14 and an inclined side wall 16. A clip 17 of resilient metal is secured to the vertical side wall 14 midway along its length at the height shown in FIG. 2. A bag 18 of material which permits water vapour and not water droplets to pass therethrough is suspended from the wedge-shaped member. The bag is adhesively secured along a rubberized rear upper edge 20 to the inclined side wall 16 of the attachment member 12. The bag 18 also has a rubberized front upper edge 22 releasably sealable to the rear upper edge 20 to enable the bag to be opened and closed in a manner which will be readily apparent to a person skilled in the art.

The bag 18 is made of synthetic plastic material comprising a filter membrane of expanded polytetrafluoroethylene carried by non-woven polyester fibres, the membrane having a pore size of about 0.02 microns. Such material may be material sold under the trade mark Gore-Tex by W. C. Gore & Associates Inc of Elktron, Md., U.S.A. The bag 18 contains reticulated foam 24 with 80 to 90 pores per inch.

For use with a guitar 26, the bag 18 is opened and foam 24 is removed, such opening being facilitated by the fact that the rubber wedge-shaped member 12 can be resiliently flexed for this purpose. The foam 24 is saturated with water and reinserted into the bag 18 which is then closed by sealing the front upper edge 22 to the rear upper edge 20 as previously described. By holding the wedge-shaped member 12, the bag 18 is lowered between two of the guitar strings 28 through the sound hole 30 into the hollow wooden body 32 of the guitar until the clip 17 is clipped over one string 28 and the inclined wedge surface 16 engages an adjacent string 29 as particularly indicated in FIG. 2. Thus, the humidification device is firmly secured to the guitar and will not dislodge even if the guitar is turned upside down. The guitar with attached humidification device can then be placed in a guitar case (not shown) and the case closed in the normal manner.

Water is released from the foam 24 and passes through the bag material in a controlled manner as vapour, not as droplets, thereby adequately humidifying the interior of the wooden guitar body 32 for a satisfactorily relatively long period of time without causing water damage thereto. It will also be noted that no part of the bag 18 is in contact with the guitar body 32 while the guitar case is in a normal orientation, and that the humidification device is attached to the guitar without the necessity for any contact with the body 32 thereby reducing the likelihood of damage thereto. Further, the ease of attachment and removal of the humidification device is readily apparent.

Typically, the wedge-shaped member may be about 7.5 cms. long, 1.8 cms wide and 3 cms deep, and the bag 18 may be about 7.5 cms long (the same as the wedge-shaped member 12), 1 cm wide and 9 cms deep.

FIGS. 5 to 8 show a humidification device for use with a violin or other member of the violin family, for example viola, cello or double bass. The humidification device comprises a rectangular rubber plate-like member 42 with the bag 18' similar to the bag 18 of the previous embodiment having its upper portion secured by adhesive to the lower surface 44 of the plate-like member 42. The bag 18' is constructed of the same material as the bag 18 of the previous embodiment and contains foam 24', the bag 18' also having a rubberized lower end edge 22' releasably securable to a rubberized upper end edge 20'.

A resilient metal clip 46 is secured to the central area of the upper surface 48 of the rubber plate-like member 42 by a pin passing through the plate-like member 42, so that the clip 46 is accordingly adjustable about the vertical axis. The clip 46 has an extension 52 beyond the pin 50, and a rubber hook 54 is carried by the end of the clip extension 52. A manually-grippable knob 56 may be secured to the upper surface of the plate-like member 42 near one end when the humidification device is of a relatively large size for use with a larger instrument such as a double bass.

The humidification device is attached to the strings 58 of a violin 60 (or other member of the violin family) by passing the plate-like member 42 and bag 18' under the strings 58 between the bridge 62 and tailpiece 54 to cause the clip 46 to receive two strings and the hook 54 to receive a third string 58, as shown particularly in FIG. 5, thereby retaining the humidification device in a position spaced from the wooden main body 70 but adjacent the two f-holes 68 in the body 70. The clip 46 can swivel about pin 50 to accommodate different taper angles of the outside strings 58 which may occur with different instruments.

When the violin 60 is in its case, water vapour released from the bag 18' passes through the f-holes 68 into the interior of the body 70, thereby efficiently humidifying the instrument interior without causing water damage thereto. No part of the bag 18' is in contact with the wooden body 70, and the humidification device is attached to the instrument without the necessity of any contact with the body 70. Also, the humidification device is readily attached and detached.

Typically, for a violin, the rubber plate-like body 42 may be about 9 cms long, 3.5 cms wide and 0.5 cm deep, the clip 46 having a total length of about 3.5 cms and a width of 1 cm, and the rubber hook 54 having a length (transversely of the plate-like member 42) of about 2.5 cms. The bag 18' may be about 1 cm deep, its other dimensions being the same as the length and width of the plate-like member 42. The humidification device may be used with a viola, with humidification devices for cellos and double basses being proportionately larger.

The advantages of the invention will be clear from the foregoing description of preferred embodiments. Other embodiments will be readily apparent to a person skilled in the art, the scope of the invention being defined in the appended claims.

I claim:

1. A humidification device for a stringed musical instrument having a hollow main body with tensioned strings extending across the body, said device comprising:

a bag comprising porous synthetic plastic material which permits water vapour and not water droplets to pass therethrough, said bag having releasable sealing means for opening and closing the bag, a water-absorbing material in said bag, and attachment means carrying said bag and attachable to at least a pair of strings of an instrument to position the bag adjacent or in the instrument body.

2. A humidification device according to claim 1 wherein the bag is of expanded polytetrafluoroethylene.

3. A humidification device according to claim 2 wherein the expanded polytetrafluoroethylene has a pore size of less than about 0.5 microns.

4. A humidification device according to claim 3 wherein the pore size is about 0.02 microns.

5. A humidification device according to claim 1 wherein the water-absorbing material comprises sponge material.

6. A humidification device according to claim 5 wherein the sponge material comprises reticulated foam.

7. A humidification device according to claim 6 wherein the foam has from about 50 to about 100 pores per inch.

8. A humidification device according to claim 7 wherein the foam has from about 80 to about 90 pores per inch.

9. A humidification device according to claim 1 wherein the attachment means comprises a generally wedge-shaped member with the bag being suspended from a narrow end thereof to enable the attachment means to be wedged between a pair of strings of a guitar, said guitar having a hollow main body with a sound hole therein, with the bag extending through the sound hole into the hollow guitar body.

10. A humidification device according to claim 9 wherein the wedge-shaped member carries a clip member engageable with one of the strings to retain the wedge-shaped member in position.

11. A humidification device according to claim 1 wherein the attachment means comprises a plate-like member carrying a pair of hook-shaped members to enable the plate-like member to be mounted under the strings with the hook-shaped members engaging a pair of strings, the bag being carried by the plate-like member so as to be positioned between the plate-like member and the body of the instrument.

* * * * *